US009854923B2

(12) United States Patent
Goppion

(10) Patent No.: US 9,854,923 B2
(45) Date of Patent: Jan. 2, 2018

(54) DISPLAY CASE HAVING REINFORCED STRUCTURE

(71) Applicant: GOPPION S.P.A., Trezzano sul Naviglio (IT)

(72) Inventor: Alessandro Goppion, Milan (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 0 days.

(21) Appl. No.: 14/490,130

(22) Filed: Sep. 18, 2014

(65) Prior Publication Data

US 2015/0130334 A1 May 14, 2015

(30) Foreign Application Priority Data

Sep. 19, 2013 (IT) ..... MI2013A1549

(51) Int. Cl.
*A47B 47/00* (2006.01)
*A47F 5/00* (2006.01)
(Continued)

(52) U.S. Cl.
CPC ..... *A47F 5/00* (2013.01); *A47B 47/042* (2013.01); *A47B 55/00* (2013.01); *A47F 3/005* (2013.01); *A47B 2220/09* (2013.01)

(58) Field of Classification Search
CPC ..... A47F 5/00; A47F 3/005; A47B 47/042; A47B 55/00; A47B 2220/09; A47B 2230/15
(Continued)

(56) References Cited

U.S. PATENT DOCUMENTS 2,246,966 A * 6/1941 Zalkind ..... 229/198.1
3,261,493 A * 7/1966 Smith ..... 217/65
(Continued)

FOREIGN PATENT DOCUMENTS

DE 202008004497 8/2008
FR 2774138 7/1999

OTHER PUBLICATIONS

English translation of FR2774138, published Jul. 30, 1999.*
(Continued)

*Primary Examiner* — Daniel J Troy
*Assistant Examiner* — Hiwot Tefera
(74) *Attorney, Agent, or Firm* — Steinfl + Bruno LLP

(57) ABSTRACT

A display case has a first display case portion with walls configured so that each wall of a plurality of first fixed walls has a coupling edge arranged at the same coupling framework between the first portion and a second portion of the display case. The coupling edges of the first fixed walls are coplanar to one another and at least two of the first fixed walls are adjacent to each other and fastened together through gluing along a corner substantially perpendicular to the plane of the coupling edges. A groove is formed longitudinally on the coupling edge of each of the first fixed walls, the grooves of the first fixed walls jointly defining a channel along the coupling framework; a hoop cable is housed in the channel, closed on itself.

The hoop cable contributes to keeping the walls coupled together at the coupling framework, ensuring that the walls stay in position even in the case in which the gluing with which the first fixed walls are fastened together partially or even totally gives way.

8 Claims, 5 Drawing Sheets

(51) Int. Cl.
*A47F 3/00* (2006.01)
*A47B 47/04* (2006.01)
*A47B 55/00* (2006.01)

(58) Field of Classification Search
USPC ..... 312/265, 111, 263, 257.1, 140, 114, 264, 312/265.5; 248/188.91, 440; 52/223.7, 52/248; 220/612, 613, 692, 4.28, 4.33
See application file for complete search history.

(56) References Cited

U.S. PATENT DOCUMENTS 3,321,259 A * 5/1967 Fiterman et al. ..... 312/259
3,556,395 A * 1/1971 Herman ..... 232/43.2
3,632,179 A * 1/1972 Vredevoogd ..... A47B 3/00 248/188.91
4,044,448 A * 8/1977 Watanabe ..... A47B 3/06 108/180
4,047,777 A * 9/1977 Pfeifer et al. ..... 312/263
4,082,825 A * 4/1978 Puterbaugh ..... 264/46.5
4,169,639 A * 10/1979 Zola ..... 312/265
4,233,656 A * 11/1980 Shemitz ..... F21V 1/00 362/352
4,239,306 A * 12/1980 Klaus ..... 312/111
4,331,368 A * 5/1982 Lien-Hsing ..... A47B 88/0018 312/263
4,886,327 A * 12/1989 Amstutz ..... A47F 3/005 312/114
5,120,116 A * 6/1992 Amstutz ..... A47F 3/005 312/114
5,244,108 A * 9/1993 Hale ..... B65D 19/06 206/596
5,265,971 A * 11/1993 Duc ..... F16B 12/12 108/152
5,378,096 A * 1/1995 Keenan ..... B60P 7/16 206/593
5,452,847 A * 9/1995 Harris ..... B65D 5/66 16/373
5,553,934 A * 9/1996 Wells et al. ..... 312/128
5,941,616 A * 8/1999 Billingham ..... 312/111
6,076,292 A * 6/2000 Kawa ..... A61G 17/08 27/1
6,318,822 B1 * 11/2001 Wang ..... 312/111
6,367,393 B1 * 4/2002 Kasten ..... A47B 3/12 108/153.1
6,398,322 B1 * 6/2002 Chaplin ..... A47F 3/005 312/114
7,264,857 B2 * 9/2007 Berchtold ..... H05K 5/062 220/214
7,533,776 B2 * 5/2009 Nickerson ..... 211/94.01
8,695,795 B1 * 4/2014 Huber ..... 206/308.1
9,532,664 B2 * 1/2017 Goppion ..... A47F 3/001
2007/0278911 A1 * 12/2007 Vallance ..... A47B 96/14 312/111
2009/0313921 A1 * 12/2009 Poirier ..... 52/204.5
2012/0242200 A1 * 9/2012 Keragala ..... A47B 47/042 312/111

OTHER PUBLICATIONS

Italian Search Report dated Jul. 29, 2014 for MI2013A001549 filed on Sep. 19, 2013.
Italian Written Opinion dated Jul. 29, 2014 for MI2013A001549 filed on Sep. 19, 2013.

* cited by examiner

DISPLAY CASE HAVING REINFORCED STRUCTURE

CROSS-REFERENCE TO RELATED APPLICATIONS

This application claims priority to Italian Application MI2013A001549 filed on Sep. 19, 2013, which is incorporated herein by reference in its entirety.

FIELDS

The present invention refers to a display case for conserving and displaying objects, such as typically works of art, objects of cultural value or in any case delicate objects, in museums, exhibitions and the like.

BACKGROUND

In particular, the display case can simply enclose the works, preventing them from being touched by people or things, or it can be such as to ensure that the works are conserved in a protected environment; here and hereafter by protected environment we means an environment in which the atmosphere is controlled, by monitoring one or more parameters from temperature, humidity, dust content, pollutant content, in order to maintain the foreseen conservation conditions of the objects displayed, and wherein unauthorised personnel are denied the possibility of access, in order to prevent theft or damage of the displayed objects.

Display cases of this type must therefore satisfy various kinds of requirements, in relation to the conservation and integrity of the displayed objects. Moreover, of course, these display cases must ensure the best visibility of the objects displayed.

Therefore, the systems for fastening the fixed parts together are very important, in order to ensure the essential solidity of the display case.

In order to improve visibility, the manufacturers of display cases try as much as possible to use transparent materials—typically glass—for the walls of display cases. As well as ensuring the best visibility of the objects displayed, the widespread use of glass is often desired by designers of display cases because the transparency of the material allows the displayed objects to be have the maximum visual impact.

Display cases have thus been developed with a base block having a casing formed from panels on top; the base block houses all of the technical components that may be necessary to ensure that the environment inside the casing is protected and is therefore normally closed by non-transparent walls, which conceal all of the technical components from view; vice-versa, the walls of the casing are made entirely or partially from glass, for the aforementioned reasons.

The casing can be made from walls of transparent material all fastened together, so as to form a bell that is lifted from the base block to gain access inside the display case. Otherwise, some walls (fixed walls) are fastened to the base block and together while one or more walls (openable walls) are mobile, thanks to suitable opening mechanisms.

In order to fasten together fixed walls made from transparent material, it is normal to glue together the walls through suitable adhesives, along adjacent peripheral edges, mostly cut to 45°.

Thanks to modern adhesives, it is possible to ensure excellent stability and safety of the gluing. However, sometimes it is still possible for anomalous, unpredictable or in any case unforeseen conditions to lead to lower solidity of gluing than expected. This can happen for example because in the gluing step there was some anomalous and not necessarily detectable condition, which can (immediately or perhaps some time later) lead to a reduction in the adhesion between the glued walls. Or else it is possible for particular environmental conditions (in terms of temperature, humidity, exposure to light or to atmospheric agents) over to modify (worsen) the adhesion characteristics of a gluing even carried out as recommended.

In these cases, the display case will be exposed to the risk of the walls becoming unstuck and therefore collapsing. This is a risk that often cannot be accepted, however small it may be, due to the delicacy and value of the works intended to be housed in the display case, which could be irredeemably damaged in the case of collapsing of the display case.

For this reason, in the case of display cases intended for delicate and/or very high value works, display cases of this type, with almost completely transparent walls, are often not used, even though this impairs visibility.

SUMMARY

Therefore, there is the problem of entirely avoiding the risk of collapse of a display case with glued walls.

Consequently, the present invention concerns a display case as defined in claim 1. Preferred characteristics are indicated in the dependent claims.

In particular, the invention concerns a display case having a first display case portion with walls configured so that each wall of a plurality of first fixed walls has a coupling edge arranged at the same coupling framework between the first portion and a second portion of the display case, in which the coupling edges of the first fixed walls are coplanar to one another and in which at least two of the first fixed walls are adjacent to each other and fastened together through gluing along a corner substantially perpendicular to the plane of the coupling edges, characterised in that it comprises:

- a groove formed longitudinally on the coupling edge of each of the first fixed walls, the grooves of the first fixed walls jointly defining a channel along the coupling framework,
- a hoop cable housed in the channel, closed on itself.

In this way, the hoop cable contributes to keeping the walls coupled together at the coupling framework, ensuring that the walls stay in position even in the case in which the gluing with which the first fixed walls are fastened together partially or even totally gives way.

The first fixed walls can be arranged in series with one another according to a succession closed on itself along the coupling framework, so that an initial first fixed wall is glud to a subsequent first fixed wall and so on up to a last first fixed wall that is glued to the initial first fixed wall. The hoop cable thus wraps around all of the first fixed walls at the coupling framework, keeping them joined together independently from the gluing.

Alternatively, the fixed walls can be arranged in series with one another according to a succession open along the coupling framework, so that at least two of the successive first fixed walls are not adjacent, and in which a strut is foreseen between these two non-adjacent successive first fixed walls, the strut comprising a coupling edge coplanar to the coupling edges of the first fixed walls and provided with a groove formed longitudinally on the coupling edge of the strut, this groove being adjacent and consecutive to the grooves of the first fixed walls so as to form, with them, the channel in which the hoop cable is housed. In this case, the "missing" wall is replaced by the strut, so that the hoop cable can equally wrap around all of the first fixed walls and the strut at the coupling framework, keeping them joined together. At the missing wall and the strut, then, the display case can be closed by an openable wall or by a mobile assebly, according to configurations known in the art.

It is also possible for there to be two missing walls (or even more in the case of polygonal display cases with a high number of sides) at the same coupling framework, each replaced by a respective strut.

Preferably, the hoop cable is closed on itself in pretensioned condition. The pretensioning promotes the exerted holding action of the hoop cable, which in this way not only ensures the structural safety of the display case in the case of the gluing giving way, but helps prevent the gluing from giving way, taking most of the holding stresses on itself and thus leaving the gluing the burden of withstanding only a minimal part of the holding stresses.

The hoop cable can be made from different materials and structures, provided that it has sufficient flexibility to adapt to the shape of the display case and of course sufficient tensile strength to ensure the desired structural resistance. Preferably, the hoop cable is a wire, strand or band of a material selected from stainless steel, carbon fibres, aramid fibres, or other suitable materials.

Preferably, the grooves have a straight side, substantially perpendicular to the plane of the coupling edges, facing towards the inside of the coupling framework. This side provides the hoop cable with a secure support surface in the direction in which the hoop cable pushes on the first fixed walls. Such a side can be easily obtained, by foreseeing a square or rectangular cross section for the grooves.

Preferably, the straight side of the grooves has a rough, knurled or fluted surface, so as to block any possible slipping of the hoop cable.

Preferably, the display case comprises adhesive material in the channel, preferably of the silicone type. This material stabilizes the positioning of the hoop cable and promotes the better transfer of stresses between the hoop cable and the walls.

Preferably, the display case comprises further adhesive material on the coupling edges at the side of the channel, in the case in which the second portion of the display case must be fixedly connected to the first fixed walls.

According to the invention, the second portion of the display case can comprise a second fixed wall, glued on the coupling edges of the first fixed walls at the coupling framework. Preferably, the first fixed walls are substantially vertical and the second fixed wall is substantially horizontal. It should be noted that with this configuration the second horizontal fixed wall rests on the first fixed walls, in particular on the coupling edges thereof that are flat and horizontal; therefore, the very weight of the second fixed wall promotes the maintaining of the gluing between this second fixed wall and the first fixed walls; moreover, also in the hypothetical case of all of the gluing giving way, the display case does not collapse, because the first fixed walls are kept in their position by the hoop cable while the second fixed wall is in any case resting on top of them.

Again according to the invention, the second portion of the display case can comprise a frame, glued on the coupling edges of the first fixed walls at the coupling framework.

In a typical configuration, the display case has a substantially parallelepiped shape and the walls have a substantially rectangular or square shape.

The fixed walls of the display case can be of any material; however, the present invention proves particularly useful when the fixed walls are made from transparent material, in particular glass. Indeed, it is normally transparent walls that are used to make couplings through gluing, potentially exposed to risks of giving way and collapsing.

BRIEF DESCRIPTION OF DRAWINGS

Further characteristics and advantages of the invention will become clearer from the following description of a preferred embodiment of a display case according to the invention, made with reference to the attached drawings. In such drawings.

DESCRIPTION

Figure 1:
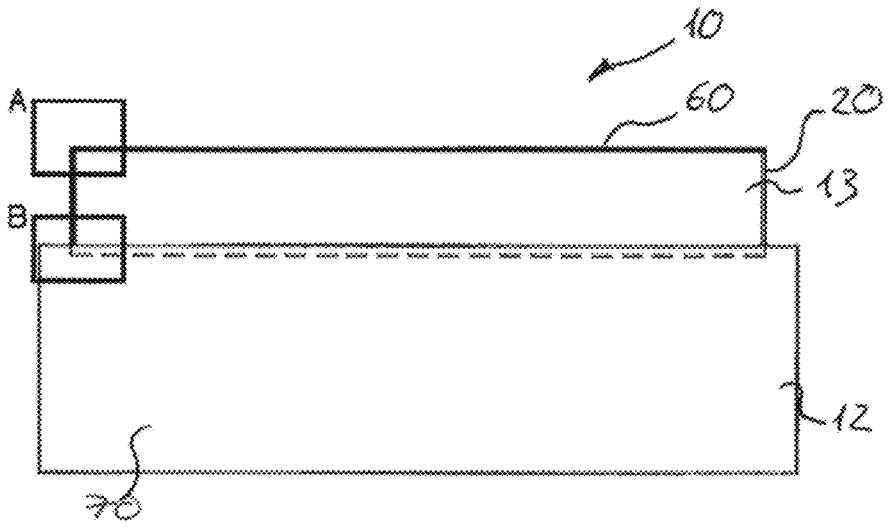
FIG. 1 is a schematic side view of a display case according to an embodiment of the invention, with a base block having a bell on top.
Figure 2:
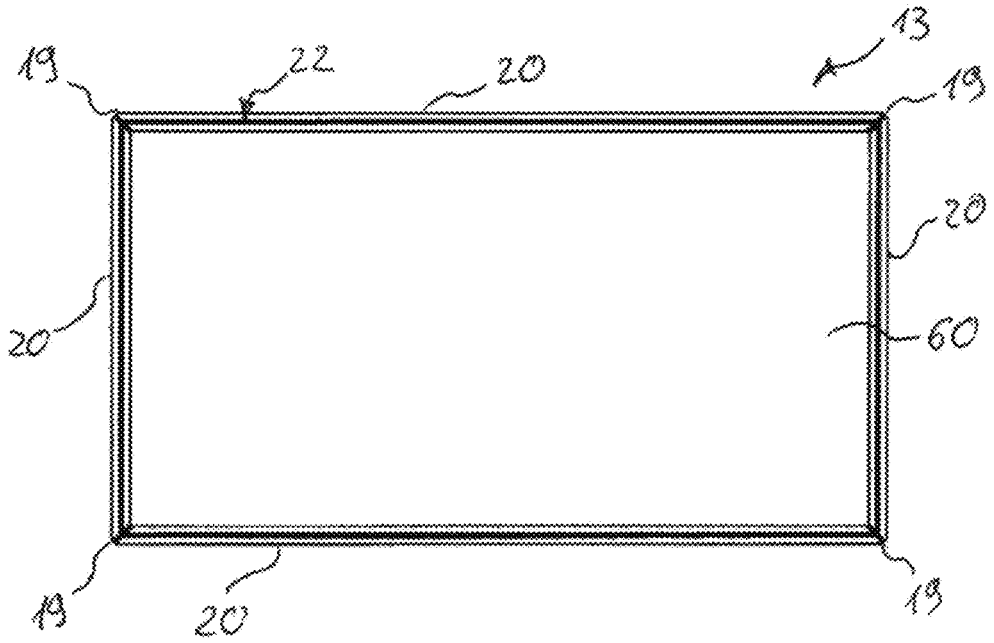
FIG. 2 is a view from above of the bell of the display case of FIG. 1.
Figure 3:
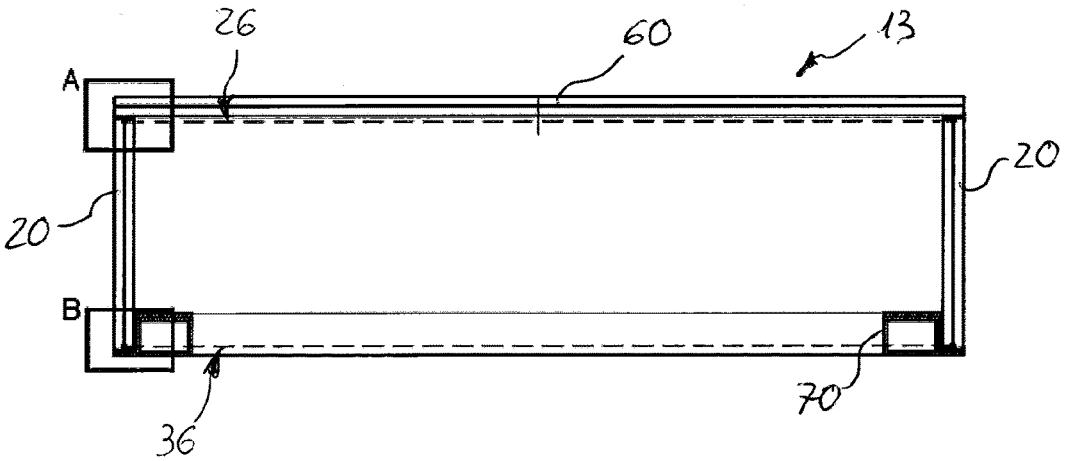
FIG. 3 is a side section view of the bell of the display case of FIG. 1.
Figure 4:
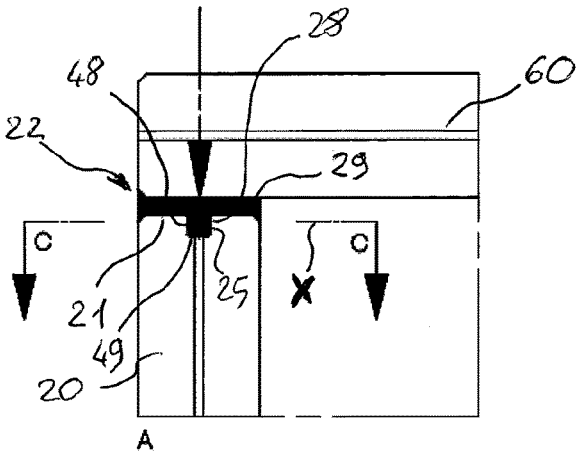
FIG. 4 is a section view of the detail A of the display case of FIG. 1.
Figure 5:
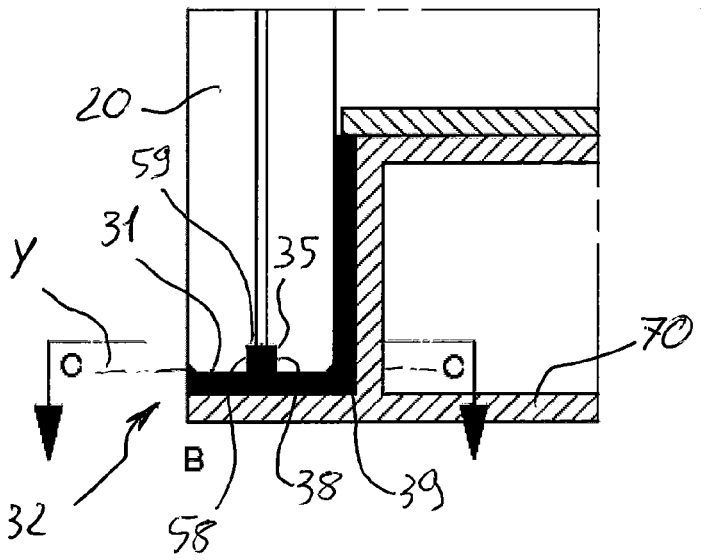
FIG. 5 is a section view of the detail B of the display case of FIG. 1.
Figure 6:
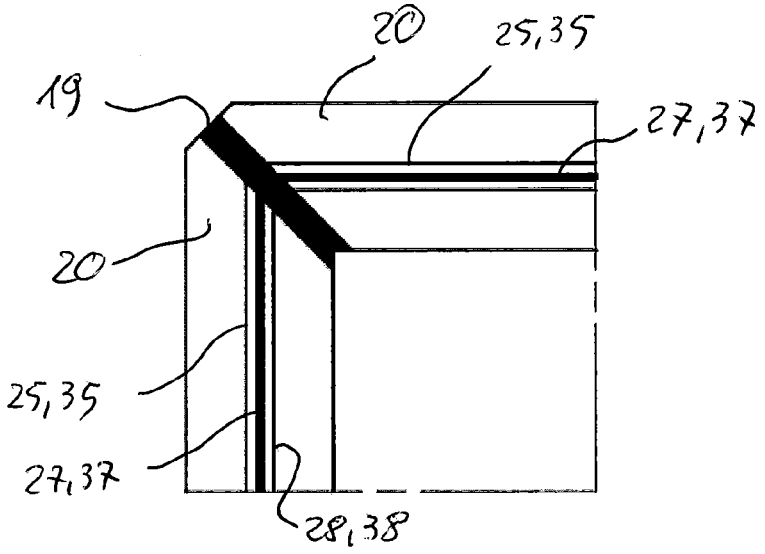
FIG. 6 is a section view along the line CC of the details A and B of FIGS. 4 and 5.
Figure 7:
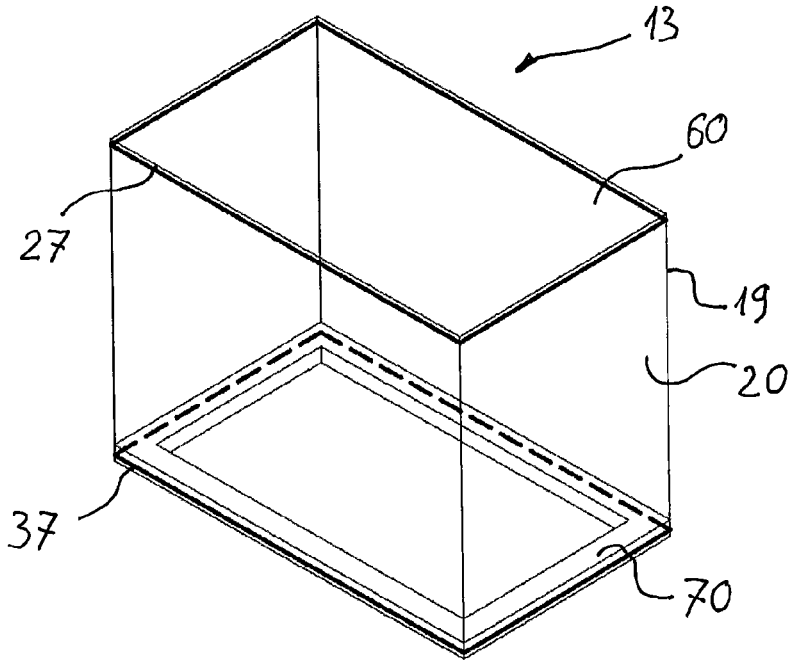
FIG. 7 is a perspective view of the bell of the display case of FIG. 1.

In FIG. 1, reference numeral 10 wholly indicates a display case according to the invention. The display case 10 comprises a base block 12, with a liftable bell 13 on top. The bell 13 is formed from fixed walls welded together, in particular four first fixed walls, vertical and lateral, all indicated with 20, with a second horizontal and upper fixed wall 60 on top, arranged above a rectangular frame 70. In the illustrated example, the display case 10 is substantially parallelepiped in shape and therefore the walls are all rectangular or square.

The display case 10 is configured so that each of the first fixed walls 20 has a coupling edge 21 on top, arranged at a coupling framework 22 between portions of the display case 10. The coupling edges 21 are coplanar to each other, according to the plane X defined by the coupling framework 22. Moreover, the display case 10 is configured so that each of the first fixed walls 20 has a coupling edge 31 at the bottom, arranged at a coupling framework 32 between portions of the display case 10. The coupling edges 31 are coplanar to one another, according to the plane Y, parallel to the plane X and defined by the coupling framework 32.

At least two of the first fixed walls 20 are adjacent to each other and fastened together through gluing (with interposition of an adhesive not highlighted in the figures) along a corner 19 substantially perpendicular to the plane X. In particular, in the display case 10 the four first fixed walls 20 are arranged in series with one another according to a succession closed on itself along the coupling framework 22, so that an initial first fixed wall 20 is glued to a subsequent first fixed wall 20 and so on up to a last first fixed wall 20 that is glued to the initial first fixed wall 20.

A groove 25 is formed longitudinally on the coupling edge 21 of each of the first fixed walls 20. The grooves 25 of the first fixed walls 20 jointly define a channel 26 along the coupling framework 22.

A groove 35 is formed longitudinally on the coupling edge 31 of each of the first fixed walls 20. The grooves 35 of the first fixed walls 20 jointly define a channel 36 along the coupling framework 22.

The display case 10 also comprises a hoop cable 27, housed in the channel 26 and closed on itself, and a hoop cable 37, housed in the channel 36 and closed on itself. Preferably, the hoop cables 27 and 37 are closed on themselves in a pretensioned condition, obviously not highlighted in the figures; the extent of this pretensioning will depend on the specific conditions (materials and sizes of the first fixed walls 20 and of the hoop cables 27 and 37).

The second fixed wall 60 is glued on the coupling edges 21 of the first fixed walls 20 at the coupling framework 22. The frame 70 is glued below the coupling edges 31 of the first fixed walls 20 at the coupling framework 32. In the display case 10, the first fixed walls 20 are substantially vertical and the second fixed wall 60 is substantially horizontal. With this configuration, the horizontal second fixed wall 60 rests on the first fixed walls 20, in particular on the coupling edges 21 thereof that are flat and horizontal in the plane X; moreover, the first fixed walls 20, in particular their coupling edges 31 that are flat and horizontal in the plane Y, rest on the horizontal frame 70.

With reference to the coupling between the first fixed walls 20 and the second fixed wall 60, in the display case 10 it is possible to identify a first display case portion that comprises the first fixed walls 20 and a second display case portion that comprises the second fixed wall 60. With reference to the coupling between the first fixed walls 20 and the frame 70, in the display case 10 it is possible to identify a first display case portion that comprises the first fixed walls 20 and a second display case portion that comprises the frame 70. Both of these subdivisions are used only for clarity of presentation of the present invention.

The hoop cable 27, 37 can be made with different materials and structures, provided that it has sufficient flexibility to adapt to the shape of the display case 10 and sufficient tensile strength to ensure the desired structural resistance. The figures do not show any particular structure for the hoop cable 27, 37 in detail; preferably, however, the hoop cable 27, 37 is a wire, strand or band of a material selected from stainless steel, carbon fibres, aramid fibres, or other suitable materials.

Preferably, the grooves 25, 35 formed in the coupling edges 21, 31 of the first fixed walls 20 have a straight side 28, 38, substantially perpendicular to the plane X, Y of the coupling edges 21, 32, facing towards the inside of the coupling framework 22, 32. The grooves 25, 35 also have another side 48, 58, opposite the straight side 28, 38, and a bottom 49, 59, both not necessarily straight; in the display case 10 illustrated as an example, both the sides 28, 38 and 48, 58, and the bottom 49, 59, are straight, so that the cross section of the grooves 25, 35 is substantially rectangular.

Preferably, the straight side 28, 38 of the grooves 25, 35 has a rough, knurled or fluted surface, to increase the friction with the hoop cable 27, 37 and therefore to obstruct any possible slipping of the hoop cable 27, 37 away frm the groove 25, 35.

Preferably, adhesive material 29, 39 for example and preferably of the silicone type is applied in the channel 26, 36 formed by the grooves 25, 35; a silicone-type adhesive can, indeed, have a transparency such as to be substantially invisible, also when applied between sheets of transparent material, for example glass. The presence of the adhesive 29, 39 stabilizes the positioning of the hoop cable 27, 37 and contributes to the better transfer of stresses between the hoop cable 27, 37 and the first fixed walls 20.

Adhesive material 29, 39 is also foreseen on the coupling edges 21, 31 adjacent to the grooves 25, 35 for gluing the second fixed wall 60 and the frame 70 to the first fixed walls 20.

It should be noted that, in the although unlikely case of all of the gluing giving way, the display case 10 does not collapse. Indeed, the first fixed walls 20 are kept in their position on the frame 70 by the hoop cable 37 as well a bound together in vertical position by the hoop cable 27, while the second fixed wall 60 is still resting on top of them.

Moreover, the holding action exerted by the hoop cable 27 allows the stresses that must be withstood by the gluing adhesive between the first fixed walls 20 to be reduced, just as the very weight (of the second fixed wall 60 and of the first fixed walls 20) promotes the maintaining of the gluing between this second fixed wall 60 and the first fixed walls 20 and between them and the frame 70.

Therefore, thanks to the invention, not only is the display case 10 itself prevented from collapsing in the case of the gluing giving way, but conditions are also ensured that cause less stress on the gluing itself, reducing the already low risk of giving way.

Figure 8:
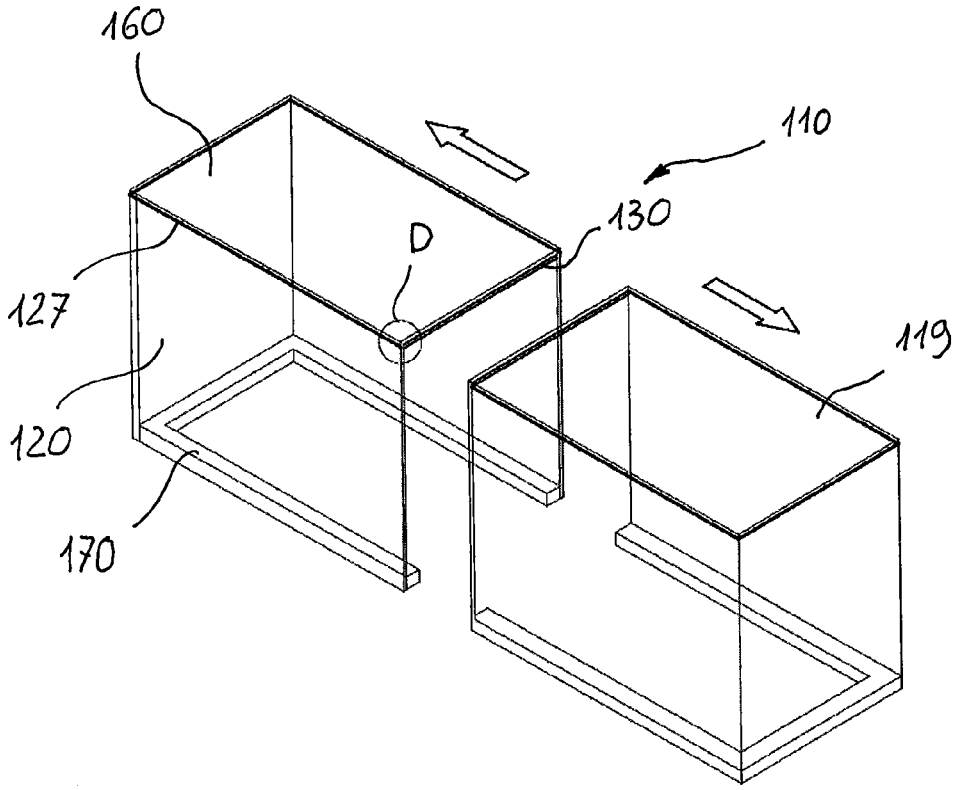
FIG. 8 is a schematic perspective view of a display case according to another embodiment of the invention.
Figure 9:
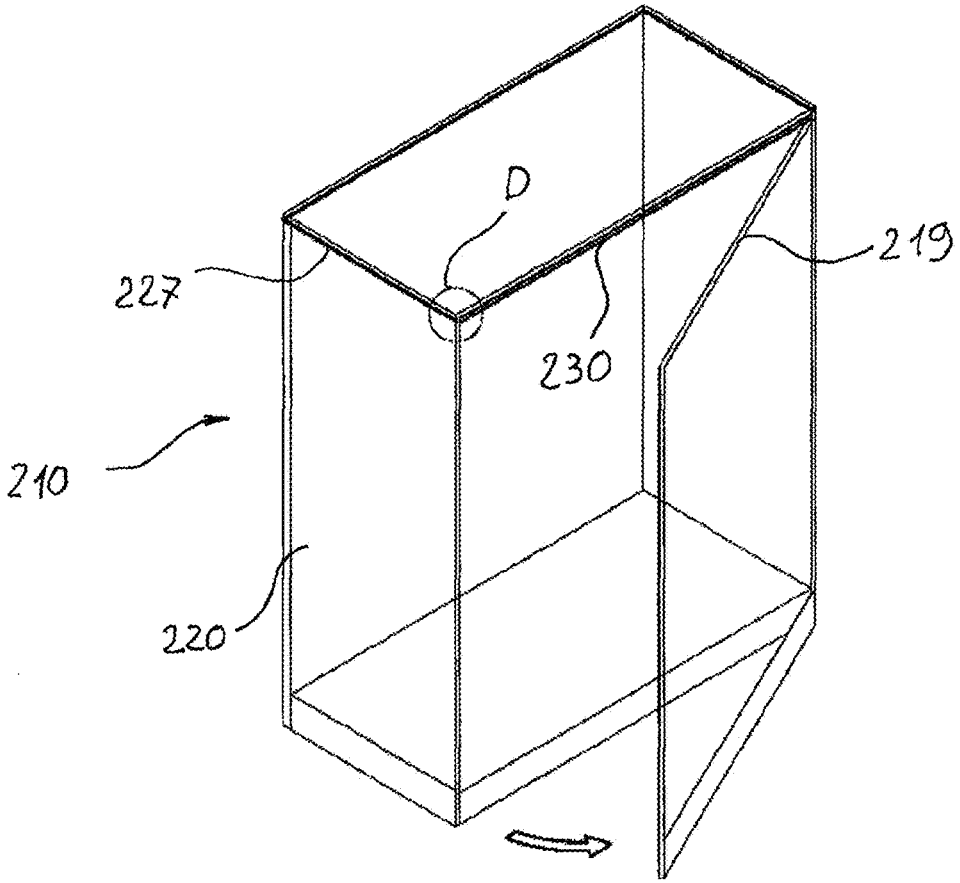
FIG. 9 is a schematic perspective view of a display case according to another embodiment of the invention.
Figure 10:
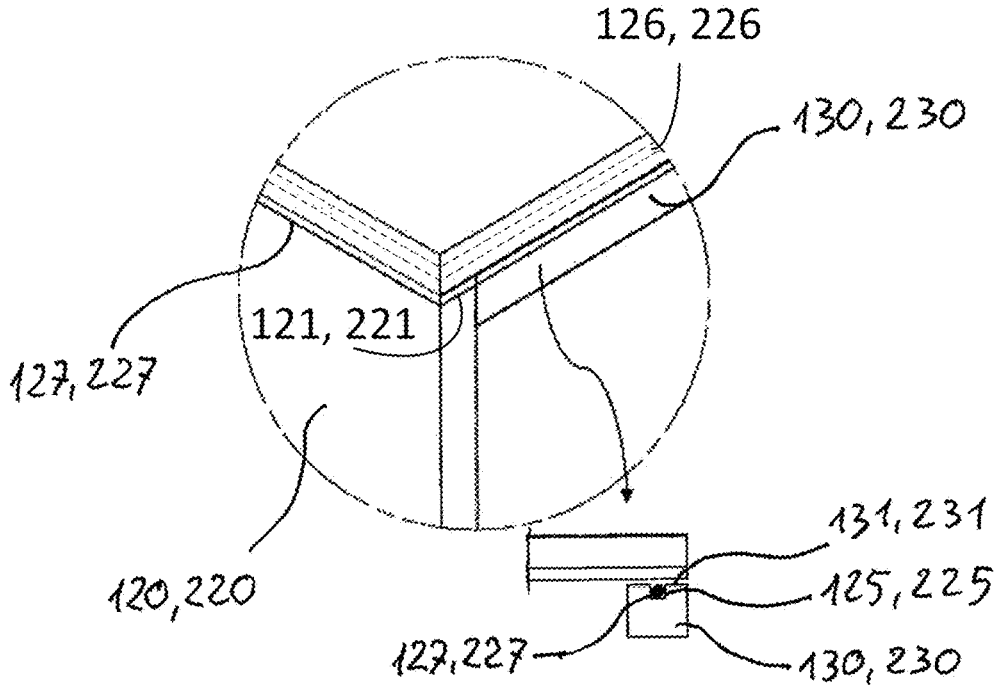
FIG. 10 is an enlarged view of the detail D, the same as in the display cases of FIGS. 8 and 9.

Display cases 110 and 210 according to other embodiments of the invention are shown in FIGS. 8 to 10. These display cases will not be described in detail, but only as far as the differences with the display case 10 are concerned; in them, the same reference numerals, increased by 100 for the display case 110 and by 200 for the display case 210, distinguish elements corresponding to those of the display case 10.

In particular, in both of the display cases 110 and 210 at least two of the successive first fixed walls 120, 220 are not adjacent, due to the presence of openable structures: a sliding half-case 119 for the display case 110 and an openable wall 219 for the display case 210. In these cases, according to the invention a strut 130, 230 is foreseen between the two successive non-adjacent first fixed walls 120, 220. The strut 130, 230 comprises a coupling edge 131, 231, coplanar to the coupling edges 121, 221 of the first fixed walls 120, 220 and provided with a groove 125, 225 formed longitudinally on the coupling edge 131, 231 of the strut 130, 230; this groove 125, 225 is adjacent and consecutive to the grooves 125, 225 of the first fixed walls 120, 220 so as to form, with them, the channel 126, 226 in which the hoop cable 127, 227 is housed.

The strut 130, 230 acts to transmit the stresses transmitted by the hoop cable 127, 227 between the two first fixed walls 120, 220 adjacent to said strut, so as to be able to use the advantages of the invention also in the presence of openable sides of the display case.

All of the walls of the display cases 10, 110, 210 are preferably made from transparent material, preferably glass.

The invention claimed is:

1. A display case, having a first display case portion with walls including a plurality of first fixed walls, configured so that each wall of the plurality of first fixed walls has a coupling edge arranged at a same coupling framework between the first and a second display case portion, wherein the coupling edges of the first fixed walls are coplanar to each other and wherein at least two of the first fixed walls are adjacent to each other and fastened together through gluing along a corner substantially perpendicular to the plane of the coupling edges, the display case comprising:

a groove formed longitudinally on the coupling edge of each of the first fixed walls, the grooves of the first fixed walls jointly defining a channel along the coupling framework, a hoop cable housed in the channel, continuously extending around the coupling framework, wherein:

the hoop cable is flexible, in a pretensioned condition and has a first end and a second end, the first end is connected to the second end, such that the cable takes the shape of a continuous hoop; and the second display case portion comprises a second fixed wall, glued onto the coupling edges of the first fixed walls at the coupling framework, wherein the first fixed walls are made from transparent material.

2. Display case according to according to claim 1, wherein the hoop cable is a wire, strand or band of a material selected from stainless steel, carbon fibres, aramid fibres.

3. Display case according to according to claim 1, wherein the grooves have a straight side, substantially perpendicular to the plane of the coupling edges, the straight side located towards the inside of the display case.

4. Display case according to claim 3, wherein the straight side of the grooves has a rough, knurled or fluted surface.

5. Display case according to according to claim 1, comprising adhesive material in the channel.

6. Display case according to claim 1, wherein the first fixed walls are substantially vertical and the second fixed wall is substantially horizontal.

7. Display case according to claim 1, wherein the display case has a substantially parallelepiped shape and the first fixed walls have a substantially rectangular or square shape.

8. A display case, having a first display case portion with walls configured so that each wall of a plurality of first fixed walls has a coupling edge arranged at a same coupling framework between the first and a second display case portion, wherein the coupling edges of the first fixed walls are coplanar to each other and wherein at least two of the first fixed walls are adjacent to each other and fastened together through gluing along a corner substantially perpendicular to the plane of the coupling edges, the display case comprising:

a groove formed longitudinally on the coupling edge of each of the first fixed walls, the grooves of the first fixed walls jointly defining a channel along the coupling framework, a hoop cable housed in the channel, continuously extending around the coupling framework, wherein:

the hoop cable is flexible, in a pretensioned condition and has a first end and a second end, the first end is connected to the second end, such that the cable takes the shape of a continuous hoop; and the second display case portion comprises a base block, glued onto the coupling edges of the first fixed walls at the coupling framework.

* * * * *